US006752346B2

(12) United States Patent
Meyer et al.

(10) Patent No.: US 6,752,346 B2
(45) Date of Patent: Jun. 22, 2004

(54) DEVICE FOR ROLLING UP MATERIAL

(75) Inventors: Joachim Meyer, Twistringen (DE); Frank Stöver, Twistringen (DE)

(73) Assignee: mst-Maschinenbau GmbH, Twistringen (DE)

( * ) Notice: Subject to any disclaimer, the term of this patent is extended or adjusted under 35 U.S.C. 154(b) by 0 days.

(21) Appl. No.: 10/255,868

(22) Filed: Sep. 26, 2002

(65) Prior Publication Data

US 2003/0234313 A1 Dec. 25, 2003

(30) Foreign Application Priority Data

Jun. 20, 2002 (DE) ..... 202 09 752 U

(51) Int. Cl.[7] ..... B65H 18/20; B65H 18/26

(52) U.S. Cl. ..... 242/533; 242/541.2; 242/541.5; 242/542; 242/548; 242/918

(58) Field of Search ..... 242/533, 541.2, 242/541.5, 541.6, 542, 542.1, 542.2, 548, 918

(56) References Cited

U.S. PATENT DOCUMENTS

| | | | | |
|---|---|---|---|---|
| 1,888,810 A | * | 11/1932 | Sieg | 242/542.1 |
| 3,850,381 A | * | 11/1974 | Moore | 242/542 |
| 4,877,196 A | | 10/1989 | Heymanns | |
| 5,289,087 A | * | 2/1994 | Summey | 242/542.1 |
| 5,655,729 A | * | 8/1997 | Casimaty et al. | 242/918 |
| 6,039,283 A | * | 3/2000 | Munoz-Baca et al. | 242/548 |
| 6,260,789 B1 | | 7/2001 | Cramer | 242/542.1 |

FOREIGN PATENT DOCUMENTS

| | | |
|---|---|---|
| CA | 2017017 | 1/1991 |
| DE | 37 19 282 | 12/1988 |
| DE | 39 24 612 | 1/1991 |
| DE | 92 04 667 | 8/1992 |
| DE | 198 24 619 | 12/1999 |
| DE | 198 48 807 | 4/2000 |
| DE | 201 02 309 | 2/2001 |

* cited by examiner

*Primary Examiner*—John M. Jillions
(74) *Attorney, Agent, or Firm*—Husch & Eppenberger, LLC; Robert E. Muir; Robert C. Haldiman

(57) ABSTRACT

A device is provided for winding a roll of a fabric web made from organic and/or synthetic fibers and which has a relatively high porous material structure and a high volume per unit area. The device includes a winding bed having a plurality of support rollers and a pressure roller located above the support rollers for exerting a pressure force on the fabric web being wound into the roll. An ascending delivery table has a distal end above the pressure roller. The support rollers and the pressure roller are rotated in the same direction during the winding process. A packing station is provided adjacent the winding bed. The direction of rotation of the support rollers is reversed to move the roll from the winding bed to the packing station.

4 Claims, 2 Drawing Sheets

DEVICE FOR ROLLING UP MATERIAL

TECHNICAL FIELD OF THE INVENTION

The invention concerns a device for winding a web of material made from organic and/or synthetic fibers and which has a relatively high porous material structure and a high volume per unit area, for example a fleece or a mat.

DESCRIPTION OF THE RELATED ART

A structurally simple and cheap device for making a coreless roll with compressed wound layers and relatively high roll diameter for materials with a porous material structure and a high volume per unit area is known from DE Utility Model 201 02 309 U1. According to the proposed solution, the web of material is delivered via an input slope to a winding station with a winding bed, which is formed by two support rollers arranged in one plane. Associated with the support rollers is a pressure roller, which is mounted rotatably in a support arm mounted pivotably on the machine frame. With different directions of rotation between the support rollers and the pressure roller, a wound roll whose wound layers are compressed initially by the weight of the pressure roller and with increasing roll diameter by an additional pressure force of a work cylinder, is formed in the winding bed. The additional pressure force acting on the pressure roller is generated by a hydraulic or pneumatic work cylinder, which is connected to the lever arm of the pressure roller. Similarly, the additional pressure force can also be applied mechanically by suitable weights.

With increasing roll diameter, the roll formed in the winding bed is guided by a pivotably mounted guide roller, which extends over the length of the support rollers. With respect to the porous material structure, with engagement of the guide roller as the roll diameter increases a quiet winding process is obtained, and at the same time it is guaranteed that with increasing roll diameter the wound roll does not jump out of the winding bed.

To increase the surface pressure and improve the bonding contact between the pressure roller and the material of the wound roll, on the outer surface of the pressure rollers are arranged bars which extend over the whole longitudinal axis of the pressure rollers.

With the proposed solution according to DE 201 02 309 U1, rolls with very high inherent stability could be made, wherein associated with the web of material on the left and right sides was a stabilizing support net which was wound in the winding station together with the web of material.

In numerous applications for webs of material with the category mentioned hereinbefore, however, only one unilateral stabilizing support net is desired, and it is required that, upon unwinding the web of material, this net structure must lie on the surface of the unrolled web of material. However, with the winding device according to DE Utility Model 201 02 309 U1, rolls of webs of material with unilateral support net cannot be made in such a way that, upon unrolling the web of material, the stabilizing net structure lies on the upper side of the unrolled web of material.

SUMMARY OF THE INVENTION

It is therefore the object of the invention to overcome one or more of the deficiencies in prior devices.

It is another object modify the winding operation and the winding device of the prior device in such a way that, upon unwinding the roll made with no core, the stabilizing net structure lies on the surface of the unrolled web of material.

According to the invention, there is provided a winding device equipped with an ascending delivery table for introduction into the winding bed of the fabric web consisting of the stabilizing support net and the web of material, which table ends over the pressure roller in its end position upon ejection of a finished roll from the winding bed, and during the winding process the support rollers forming the winding bed and the pressure roller all rotate in the same direction.

After completion of the roll made with no core, the direction of rotation of the support rollers is reversed relative to the pressure roller, and the fully wound fabric web is transferred to an adjacent packing station.

The invention will be described in more detail below by a practical example. The associated drawings show in the schematic views 1 to 5 the individual stages of the winding process and subsequent transfer of the wound fabric web to the packing station.

BRIEF DESCRIPTION OF THE DRAWINGS

Reference is now made more particularly to the drawings which illustrate the best presently known mode of carrying out the invention and wherein similar reference characters indicate the same parts throughout the views.

DETAILED DESCRIPTION

Figure 5:
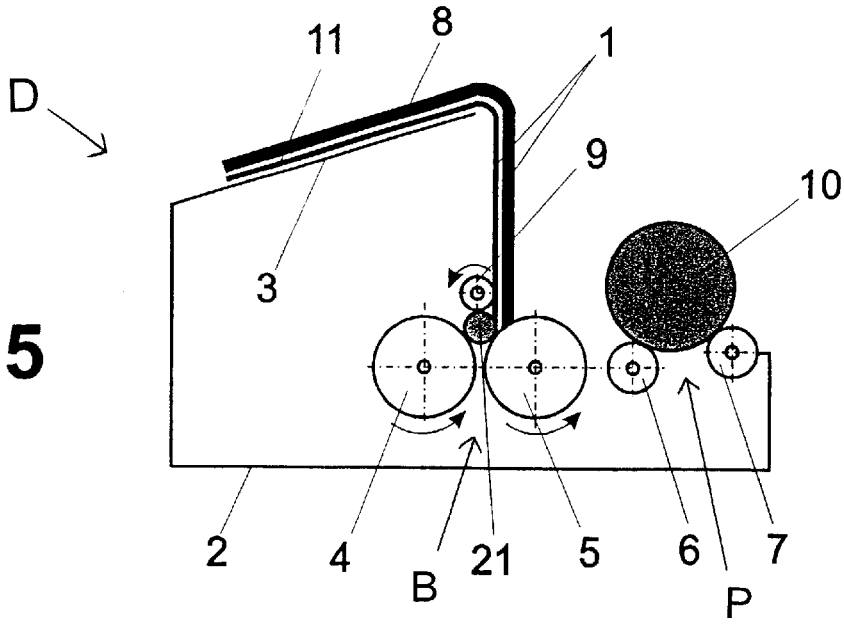
FIG. 5 is a schematic view showing the winding device during a first or starting stage for another rolled fabric web, with the first rolled fabric web at the packing station.

As can be seen from FIG. 5, two support rollers 4 and 5 are mounted rotatably in the frame 2 of a winding device D and arranged in such a way that between them is formed a winding bed B. In winding bed B a fabric web 1, consisting of a web of material 8 with a relatively high porous material structure and a unilateral support net 11 for stabilizing the web of material 8, is wound with no core. In the same frame 2 adjacent to the winding device D is provided a packing station P, consisting of the rollers 6 and 7, to which the finished roll 10 is transferred at the end of the winding process. The frame 2 of the winding device is equipped with an ascending delivery table 3 which terminates at a distal end above the pressure roller 9. As can be seen from FIGS. 1, 2 and 5, it is over the distal end of delivery table 3 that the web of material 8 to be wound is delivered together with the support net 11 and introduced into the winding bed B.

Figure 1:
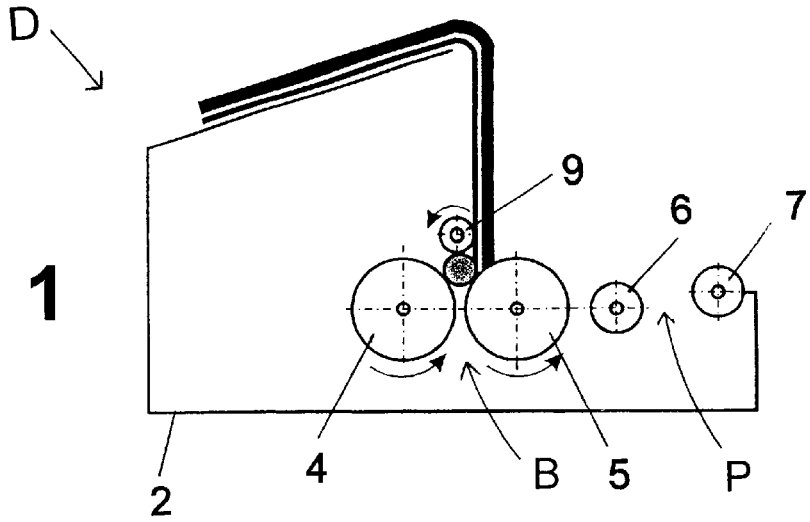
FIG. 1 is a schematic view showing a winding device during a first or starting stage of the winding process.
Figure 2:
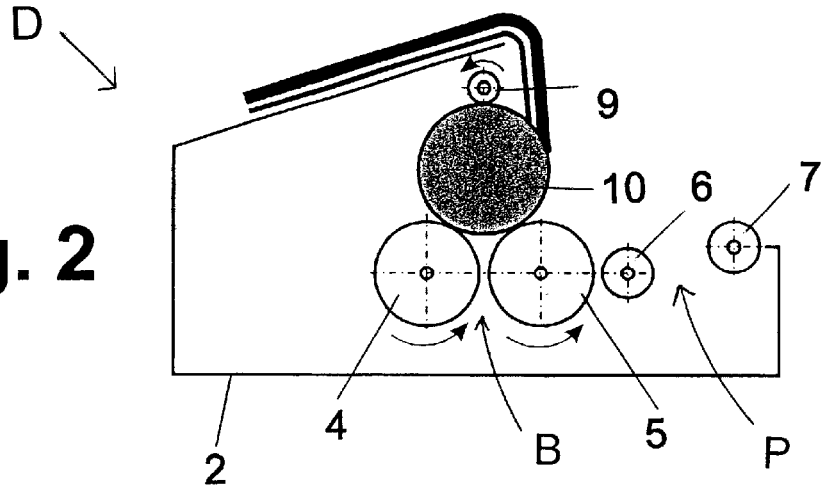
FIG. 2 is a schematic view showing the winding device during a second or final stage of the winding process.
Figure 3:
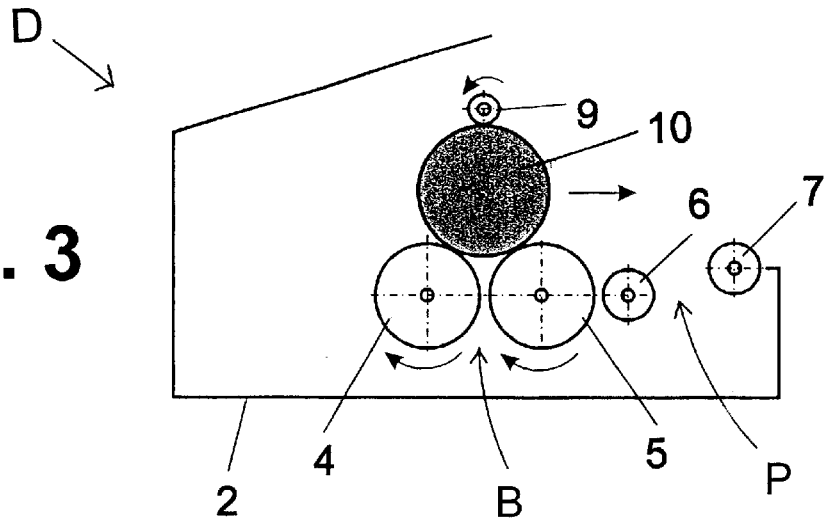
FIG. 3 is a schematic view showing the winding device during a start of transfer of the rolled fabric web to a packing station.
Figure 4:
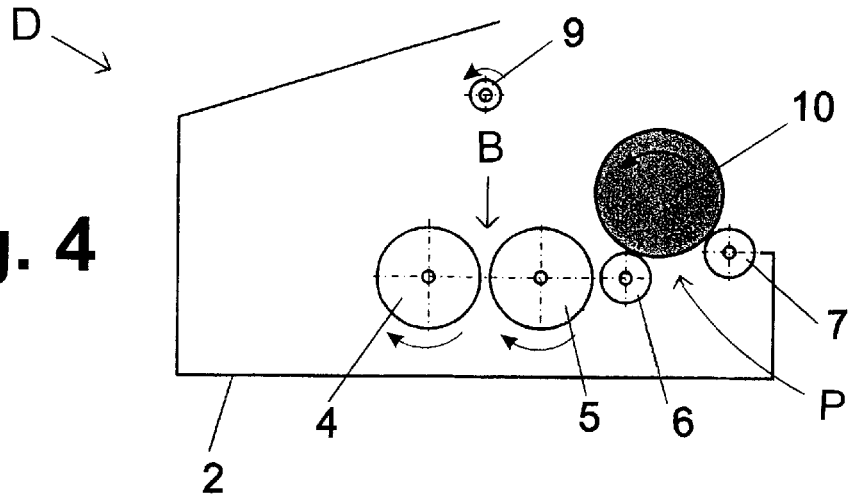
FIG. 4 is a schematic view showing the winding device after transfer of the rolled fabric web to the packing station.

To manufacture the roll 10, the support rollers 4 and 5 and the pressure roller 9 are all rotated in the same direction, i.e. an anti-clockwise direction as viewed in FIGS. 1, 2 and 5. As seen in FIG. 3, at the end of the winding process, the direction of rotation of the support rollers 4, 5 is reversed but not the direction of rotation of pressure roller 9. This causes the fully wound fabric web 10 to be transferred to the packing station P as shown in FIG. 4. Immediately after transfer of the roll to the packing station P, the direction of rotation of the support rollers 4, 5 is reversed to the winding direction shown in FIG. 5, and the manufacture of a new roll 21 is commenced.

The invention in its broader aspects is not limited to the specific steps and apparatus shown and described, but departures may be made therefrom within the scope of the accompanying claims without departing from the principles of the invention and without sacrificing its chief advantages.

What is claimed is:

1. A device for winding a roll of a fabric web made from organic and/or synthetic fibers and which has a relatively high porous material structure and a high volume per unit area, the device including a winding bed having a plurality of support rollers and a pressure roller located above the support rollers for exerting a pressure force on the fabric web being wound into the roll, an ascending delivery table having a distal end above the pressure roller, and means for rotating the support rollers and the pressure roller in the same direction during the winding process.

2. A device as set forth in claim 1, wherein the direction of rotation of the support rollers is reversible, and wherein the means for rotating the support rollers includes means for reversing the rotation of the support rollers but not the pressure roller.

3. A device as set forth in claim 1, including a packing station adjacent the winding bed, wherein the direction of rotation of the support rollers is reversible, and for discharge of a finished roll from the winding device to the packing station the reversible direction of rotation of the support rollers is opposite that of the pressure roller.

4. A device as set forth in claim 2, wherein reversing the rotation of the support rollers but not the pressure roller is operative to discharge a finished roll from the winding bed; and including a station adjacent the winding bed for receiving the discharged roll.

* * * * *